US008863890B2

(12) United States Patent
Inglis et al.

(10) Patent No.: US 8,863,890 B2
(45) Date of Patent: Oct. 21, 2014

(54) COATED SPEAKER DOME AND COATED DIAMOND PRODUCTS

(75) Inventors: Paul Nicholas Inglis, Ascot (GB); John Robert Brandon, Ascot (GB); Neil Perkins, Ascot (GB)

(73) Assignee: Element Six Limited (IM)

( * ) Notice: Subject to any disclaimer, the term of this patent is extended or adjusted under 35 U.S.C. 154(b) by 0 days.

(21) Appl. No.: 13/984,655

(22) PCT Filed: Feb. 7, 2012

(86) PCT No.: PCT/EP2012/052020
§ 371 (c)(1),
(2), (4) Date: Sep. 18, 2013

(87) PCT Pub. No.: WO2012/110357
PCT Pub. Date: Aug. 23, 2012

(65) Prior Publication Data

US 2014/0158456 A1 Jun. 12, 2014

(30) Foreign Application Priority Data

Feb. 14, 2011 (GB) ..... 1102547.5

(51) Int. Cl.
*G10K 13/00* (2006.01)

(52) U.S. Cl.
USPC ..... 181/168; 181/167

(58) Field of Classification Search
USPC ..... 181/168, 167
See application file for complete search history.

(56) References Cited

U.S. PATENT DOCUMENTS

| | | | | |
|---|---|---|---|---|
| 4,470,479 | A * | 9/1984 | Inoue et al. | 181/168 |
| 5,080,743 | A * | 1/1992 | Odajima | 156/243 |
| 8,340,341 | B2 * | 12/2012 | Perkins et al. | 381/426 |
| 2003/0134135 | A1 | 7/2003 | Noda | |
| 2005/0257999 | A1 * | 11/2005 | Tomiyama et al. | 181/168 |

FOREIGN PATENT DOCUMENTS

| | | | |
|---|---|---|---|
| DE | 10049744 | A1 | 10/2002 |
| EP | 0341589 | A2 | 11/1989 |
| EP | 1711032 | A2 | 10/2006 |
| GB | 2236541 | A | 4/1991 |

(Continued)

OTHER PUBLICATIONS

International Search Report for PCT/EP2012/052020 dated May 7, 2012.

(Continued)

*Primary Examiner* — Forrest M Phillips
(74) *Attorney, Agent, or Firm* — Bryan Cave LLP

(57) ABSTRACT

The invention relates to a speaker dome comprising: a polycrystalline diamond dome body formed of a material of high stiffness with a Young's modulus greater than 50 GPa and having respective inner and outer surfaces; and a coating on at least one side of the dome body, wherein the coating comprises an optically refractive metal compound layer which is semi-transparent and which forms one or more colors via interference of reflected light from front and rear surfaces of the layer. The invention also relates to a diamond component comprising: a diamond body; and a coating on at least one side of the diamond body, wherein the coating comprises at least two layers including a first layer bonded to the at least one side of the diamond body and a second layer disposed over the first layer, the second layer being an optically refractive metal compound coating which is semi-transparent and which forms one or more colors via interference of reflected light from front and rear surfaces of the second layer.

23 Claims, 2 Drawing Sheets

(56) References Cited

FOREIGN PATENT DOCUMENTS

| | | | |
|---|---|---|---|
| JP | 01-282997 | A | 11/1989 |
| JP | 02-022471 | A | 1/1990 |
| JP | 02152399 | A | 6/1990 |
| JP | 05214888 | A | 8/1993 |
| JP | 05221792 | A | 8/1993 |
| WO | 2005101900 | A1 | 10/2005 |
| WO | 2006075238 | A2 | 7/2006 |

OTHER PUBLICATIONS

Search Report for GB1202043.4 dated Apr. 23, 2012.
Search Report for GB1102547.5 dated Mar. 25, 2011.

* cited by examiner

COATED SPEAKER DOME AND COATED DIAMOND PRODUCTS

FIELD OF INVENTION

Certain embodiments of the present invention relate to coated speaker domes for high-end audio equipment. Certain further embodiments of the present invention relate to coated diamond products including items such as speaker domes.

BACKGROUND OF INVENTION

Diamonds have long been used in jewellery due to their long life and aesthetic appeal. Diamond materials also have a range of desirable properties for a large number of different technical applications. For example, diamond material is light in weight and very stiff/rigid. These properties result in diamond being an excellent material for use in forming a speaker dome for high-end audio equipment. Such speaker domes can form high frequency tweeters with a very high break-up frequency beyond the human audio range so as to produce a very high quality sound in the human audio range. For example, WO2005/101900 discloses such a diamond speaker dome. As described in WO2005/101900, harmonics can extend below the fundamental break-up frequency so it is desirable for the break-up frequency to be well removed from the end of the human audio range to ensure that sound reproduction is not impaired by flexing of the speaker dome at high frequency oscillation.

Coating diamond speaker domes is known in the art. For example, WO2006/075238 discloses speaker domes with a coating designed to act as a damping medium and/or alter the appearance of the speaker dome. Various possible coatings are disclosed including metals, polymers, plastics and other solid organic coating materials. It is also disclosed that the coating may comprise more than one layer including a first layer providing good adhesion to the surface of the body of the speaker dome and a second layer providing damping, optical opacity and/or colour. One disclosed arrangement comprises a first layer having apertures defining a character, trademark or symbol, and a second coloured transparent layer disposed over the apertures in the first layer such that the coating provides a coloured character, trademark or symbol when backlit.

One potential problem with the aforementioned arrangements is that single layer structures need to be selected for their adhesion to the speaker dome body which limits the range of colours which can be applied. Furthermore, a potential problem with multilayered coatings is that such coatings can be too thick and/or heavy and adversely affect the vibrational response of the speaker dome, serving to reduce the break up frequency and inhibit device sensitivity. Further still, to form colours requires a relatively thick opaque layer for reflecting light or a relatively thick transparent layer with backlighting to form strong colours by way of absorption in accordance with the teachings of the prior art discussed above.

It is an aim of certain embodiments of the present invention to solve the aforementioned problems. Certain embodiments relate to the technical problem of how to coat a diamond body to alter its aesthetic appearance without detrimentally affecting the functional properties of the diamond body.

SUMMARY OF INVENTION

According to certain embodiments of the present invention there is provide a speaker dome comprising:

a dome body formed of a material of high stiffness with a Young's modulus greater than 50 GPa and having respective inner and outer surfaces; and a coating on at least one side of the dome body, wherein the coating comprises an optically refractive layer which is semi-transparent and which forms one or more colours via interference of reflected light from front and rear surfaces of the layer, wherein the dome body is formed of polycrystalline diamond material, and wherein the optically refractive layer is formed of a metal compound.

According to certain further embodiments of the present invention there is provided a method of forming a speaker dome, the method comprising:

providing a polycrystalline diamond dome body; and coating at least one side of the dome body with a coating, wherein the coating comprises an optically refractive metal compound layer which is semi-transparent and which forms one or more colours via interference of reflected light from front and rear surfaces of the layer.

According to certain further embodiments of the present invention there is provided a diamond component comprising:

a diamond body; and a coating on at least one side of the diamond body, wherein the coating comprises at least two layers including a first layer bonded to the at least one side of the diamond body and a second layer disposed over the first layer, the second layer being an optically refractive metal compound coating which is semi-transparent and which forms one or more colours via interference of reflected light from front and rear surfaces of the second layer.

BRIEF DESCRIPTION OF THE DRAWINGS

For a better understanding of the present invention and to show how the same may be carried into effect, embodiments of the present invention will now be described by way of example only with reference to the accompanying drawings, in which.

DETAILED DESCRIPTION OF CERTAIN EMBODIMENTS

Figure 1:
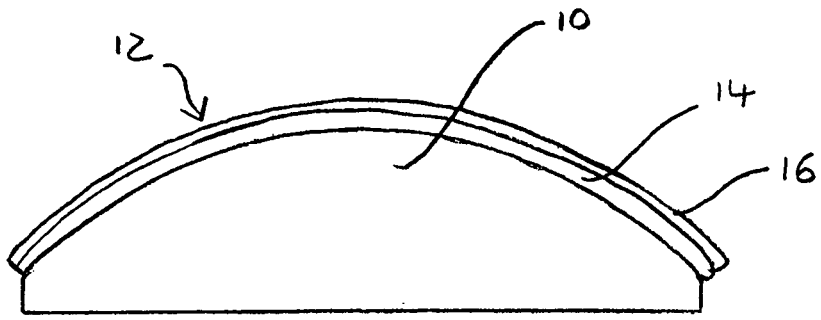
FIG. 1 illustrates a side cross-sectional view of a coated speaker dome in accordance with an embodiment of the present invention.

Embodiments of the present invention are based on the realisation that rather than providing a transparent coating or a reflective opaque coating for forming a coloured coating on a diamond body, it is advantageous to utilize an optically refractive metal compound coating which is semi-transparent and which forms one or more colours via interference of reflected light from front and rear surfaces of the layer. While such coatings are known for other applications, the present inventors have realized that they would be ideal for use in coating polycrystalline diamond speaker domes as they can produce strong colours when made very thin and light so as to not detrimentally affect the vibrational properties of the polycrystalline diamond speaker dome when compared with transparent or opaque reflective coatings which are required to be made much thicker to produce strong colours. Another advantage is that colour variants can be made relatively easily by only minor changes to the manufacturing process as the same coating material can produce a range of colours by simply making slight variations to the thickness of the layer. Further still, materials such as metal oxides suitable for forming a semi-transparent interference coating are relatively hard and thus a relatively robust coating can be achieved.

It is notable that WO2006/075238, which describes coating of diamond speaker domes and is discussed in the background section of this specification, mentions that adhesion of coatings to diamond material is problematic and that materials such as titanium metal are particularly applicable as this provides good adhesion to the diamond material of the speaker dome. In fact, a skilled person in this art would understand that diamond material is extremely "non-stick" and that adhering coatings to diamond material is not trivial. As implied by WO2006/075238, a coating material must be carefully selected to ensure good adhesion to diamond material. Furthermore, diamond material is known to have an extremely low thermal expansion coefficient which will inevitable result in a thermal mismatch between the diamond material and another material used as a coating. Such a thermal mismatch can lead to thermally induced stress which can cause cracking of the coating unless the coating is sufficiently elastic to deform and alleviate such stress. As such, WO2006/075238 discloses elastic materials which are highly adhesive such as metals, polymers, plastics and other solid organic coating materials for use with diamond material. In fact, it is surprising that a rigid, low elasticity, optically refractive layer such as a metal oxide layer can be used to coat a diamond speaker dome in such a way as to provide good adhesion and also not crack and delaminate from the diamond material in use due to thermal mismatches. Accordingly, it was not considered obvious to try applying such a coating to a diamond loudspeaker diaphragm and that this would be successful.

In order to robustly mount a semi-transparent interference coating to a polycrystalline diamond speaker dome it can be useful in certain coating methods to provide a first layer which is selected for its adherence to the speaker dome body with the semi-transparent interference coating being disposed over the first layer. Such a bonding layer is particularly useful if the speaker dome body is made of a material which has a poor adherence to the material used for the semi-transparent interference coating. In addition, the bonding layer may be opaque to visually mask the underlying speaker dome and/or aid in reflect light from a rear surface of the semi-transparent interference coating. As such, it may be advantageous to provide a coating comprising at least two layers including a first layer bonded to at least one side of the dome body and a second layer disposed over the first layer, the second layer being formed by the semi-transparent interference coating.

The first layer optionally has a thickness in the range 10 nm to 5 μm, 50 nm to 1 μm, or 50 nm to 500 nm. The first layer is preferably opaque and most preferably reflective with a reflection co-efficient of 0.3 to 0.25 and a refractive index of between 1.5 and 3 such that light cannot easily penetrate through the layer. The first layer may be formed of a metal or metal alloy. Suitable examples of materials for the first layer include one or more of titanium, tungsten, silicon, silver, platinum, aluminium, or gold, or an alloy thereof. Alternatively, a reflective coating can be constructed from a multiple layers of dielectric materials having appropriate refractive indices and layer thickness, commonly known as a Bragg reflector. In the latter case however the reflective properties may alter with angle of incidence. A Bragg reflector is constructed by coating alternating materials onto a surface with alternating high and low values of refractive index. Examples of materials which could be used to achieve this effect include inorganic oxides such as $TiO_2$ and $SiO_2$ with refractive indices of 2.4 and 1.4 respectively. The coating thicknesses of the layers are chosen such that the path length differences for reflections from the alternating materials are integer multiples of the wavelength for which the Bragg reflector is designed.

The semi-transparent interference layer (i.e. the optically refractive layer) optionally has a thickness in the range 10 nm to 5 μm, 50 nm to 1 μm, or 50 nm to 500 nm. The coating thickness can act to alter the perceived colour. As such, the optically refractive layer preferably has a thickness uniformity less than 200 nm or less than 20% of an average thickness of the optically refractive layer. The layer is formed of a metal compound such as a metal oxide or a metal nitride, for example titanium oxide, zirconium nitride, chromium nitride, erbium oxide, titanium nitride, or silicon nitride.

Although the coating may conceivably contain more than two layers as previously described, it is advantageous to limit the thickness and weight of the coating as this can adversely affect the vibrational response of the speaker dome. Accordingly, in certain applications it is advantageous that the coating consists of only the first and second layers with no further layers provided in the coating.

The dome body should be made of a material which has high stiffness with a Young's modulus greater than 50 GPa, preferably greater than 100 GPa, 200 GPa, 300 GPa, 500 GPa, or 1000 GPa. The dome body should also preferably be made of a material which is also light. Polycrystalline diamond fulfils these requirements. Typical values of Young's modulus for competitive materials and polycrystalline diamond are as follows: Mg=45 GPa; Al=50 GPa; Au=79 GPa; Be=287 GPa; Sapphire=345 GPa; polycrystalline diamond=1143 GPa.

A polycrystalline diamond speaker dome can be manufactured using a chemical vapour deposition technique such as microwave plasma activated CVD diamond growth. The dome body may have a thickness in the range 5 μm to 500 μm, 20 μm to 100 μm, 30 μm to 70 μm, or 40 μm to 50 μm. The dome body may have a diameter in the range 10 mm to 100 mm, 10 mm to 50 mm, or 15 mm to 40 mm. The dome body may also comprise a skirt around the periphery of the body in a similar manner to that described in WO2005/101900. The coating of the present invention may be disposed on a convex side of the dome body and may form a continuous coating over at least 90% of at least one side of the dome body. In a two layer arrangement, it is preferred that both layers form continuous layers over at least 90% of at least one side of the dome body. If a skirt is present, the coating may or may not cover the skirt.

The coating according to embodiments of the present invention has been found to be particularly useful at masking stains within a polycrystalline diamond speaker dome formed during treatment of the dome using a ferrofluid. Ferrofluid is often used to treat speaker domes but it has been found that a visually poor stain can result. Stains can also occur as a result of fingerprints or from the use of adhesives. This staining can be masked by a coating according to the present invention without unduly affecting the functional performance of the speaker dome when compared to other known coatings. A two layer coating comprising a base layer and an over-layer has been found to work particularly well for this application. The over-layer is an optically refractive coating which is semi-transparent and which forms a colour via interference of reflected light from front and rear surfaces of the layer rather than merely by reflection from an outer surface. The base coating may be selected to provide a good bond between the diamond speaker dome and the overlying layer. The base coating is preferably opaque to hide any ferrofluid or other visually poor attributes of the speaker dome. The base coating should preferably be made of a material which has high optical absorption or scatter such that the base coating is opaque at a low thickness thus limiting additional mass and the associated detrimental effect on break-up frequency. The base material can be selected for its functional properties rather than its visual appeal. The base layer may preferably be a metal. Examples include titanium, tungsten, silicon, platinum, silver, and gold.

A coated speaker dome as described herein may have a break-up frequency greater than 25 kHz, 35, kHz, 40 kHz, or 45 kHz and a deviation in an on-axis response curve from a flat response, measured at 4/5 of the break-up frequency, of less than 3 dB.

Figure 2:
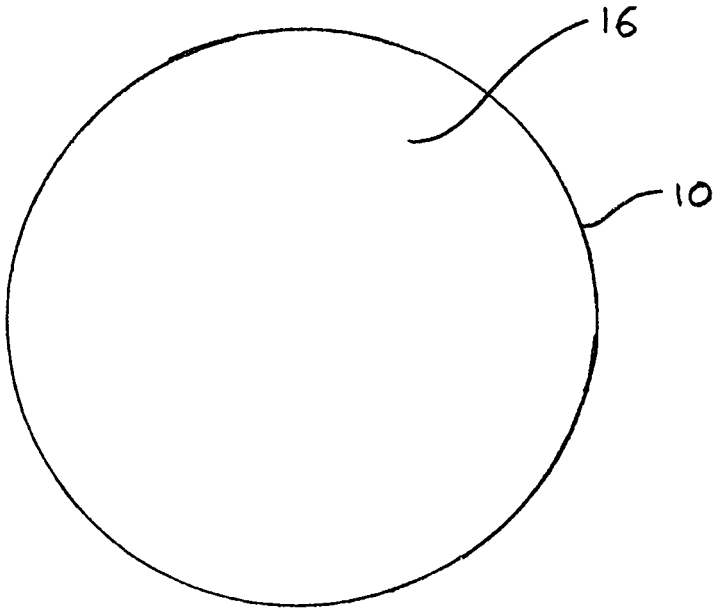
FIG. 2 illustrates a front view of a coated speaker dome in accordance with an embodiment of the present invention.

FIGS. 1 and 2 illustrate a speaker dome according to an embodiment of the invention. The speaker dome comprises a dome body 10 formed of a material of high stiffness or high rigidity and having respective inner and outer surfaces. A coating 12 is provided on at least one side of the dome body 10. The coating 12 comprises at least two layers including a first layer 14 bonded to the at least one side of the dome body 10 and a second layer 16 disposed over the first layer 14. The second layer 16 is formed of an optically refractive coating which is semi-transparent and which forms one or more colours via interference of reflected light from front and rear surfaces thereof. In the illustrated embodiment, the dome body comprises a skirt 18 around the periphery of the body in a similar manner to that described in WO2005/101900.

The speaker dome may be formed by providing a dome body and coating at least one side of the dome body with a two layer coating as described herein. The first layer may be deposited on the at least one side of the dome body using any one of a number of techniques including vacuum deposition, sputtering, electroless plating, evaporative coating, powder coating, wet spray coating, and dip coating. The second layer may be deposited over the first layer using one of these techniques.

The speaker dome body may be formed by depositing a polycrystalline diamond material using a chemical vapour deposition technique as is known in the art. For example, a dome shaped substrate may be provided and polycrystalline diamond material deposited in a microwave plasma activated. CVD reactor over the dome shaped substrate to form a polycrystalline diamond body. The polycrystalline diamond body may then be removed form the substrate. For example, if the substrate is silicon the substrate can be removed by dissolving in acid to yield a free-standing polycrystalline diamond body.

After forming the diamond body as described above, the diamond body can then be coated as previously described. Optionally, the growth face of the diamond body is coated. This may be the convex face of the diamond body if a convex dome-shaped substrate is utilized for growing the polycrystalline diamond body; Alternatively, it is also envisaged that a concave growth surface may be provided in a substrate for growth of the diamond body such that the growth face of the diamond body is concave. Alternatively the concave nucleation face of a dome grown on a convex substrate may be coated to give a dome with a smoother appearance.

Although the present invention was originally developed for use with speaker domes, it has been realized that the two layer coating of embodiments of the present invention may be utilized for coating other diamond bodies, particularly diamond bodies comprising polycrystalline diamond material. Diamond bodies may be used for a range of applications such as optical windows, cutters, wear parts, detectors, electronic substrates and/or as a heat sink in electronic devices. Diamond may also be doped to provide active semi-conductive or fully conductive elements for electronic applications. While high purity single crystal diamond is well known to be aesthetically pleasing, lower quality single crystal material and/or polycrystalline material can be less visually appealing. As such, the present inventors have considered that in certain circumstances it may be desirable to coat diamond material to improve is aesthetic appeal and/or to mark the diamond material for identification and/or branding purposes. However, it has been recognized that coating the diamond material may be detrimental to its functional properties.

Figure 3:
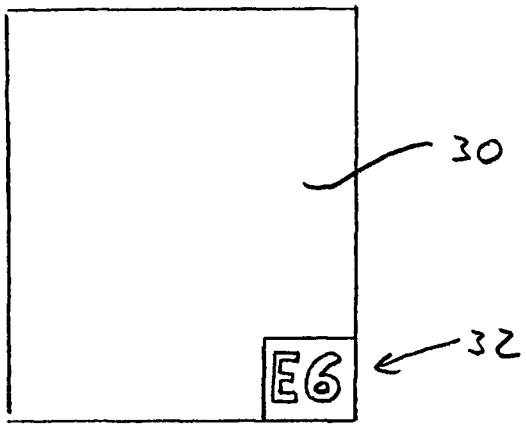
FIG. 3 illustrates a polycrystalline diamond body comprising a coating forming a logo in accordance with a further embodiment of the present invention.

Accordingly, certain further embodiments of the present invention provide a diamond body comprising a coating on at least one side of the body, wherein the coating comprises at least two layers as described herein. For example, the two-layer coating may form a continuous coating over one or more surfaces of the diamond body or be patterned such as to form a logo. In this regard, FIG. 3 shows such an alternative embodiment comprising a diamond body 30 comprising a logo 32. The logo 32 comprises a two layer coating as described herein, patterned using standard lithographic techniques. For example, the coating may comprise a first layer of silver and an overlying interference coating. The interference coating may be patterned to define the logo with the underlying silver exposed to form the logo. Embodiments of the present invention can thus be used for branding as well as to achieve a range of attractive colours.

While this invention has been particularly shown and described with reference to preferred embodiments, it will be understood to those skilled in the art that various changes in form and detail may be made without departing from the scope of the invention as defined by the appendant claims.

The invention claimed is:

1. A speaker dome comprising:

a dome body formed of a material of high stiffness with a Young's modulus greater than 50 GPa and having respective inner and outer surfaces; and a coating on at least one side of the dome body, wherein the coating comprises an optically refractive layer which is semi-transparent and which forms one or more colours via interference of reflected light from front and rear surfaces of the layer, wherein the dome body is formed of polycrystalline diamond material, and wherein the optically refractive layer is formed of a metal compound.

2. A speaker dome according to claim 1, wherein the optically refractive layer has a thickness in the range 10 nm to 5 μm, 50 nm to 1 μm, or 50 nm to 500 nm.

3. A speaker dome according to claim 1, wherein the optically refractive layer has a thickness uniformity less than 200 nm or less than 20% of an average thickness of the optically refractive layer.

4. A speaker dome according to claim 1, wherein the metal compound is a metal oxide or a metal nitride.

5. A speaker dome according to claim 4, wherein the metal compound is one of titanium oxide, zirconium nitride, chromium nitride, erbium oxide, titanium nitride, or silicon nitride.

6. A speaker dome according to claim 1, wherein the coating comprises at least two layers including a first layer bonded to the at least one side of the dome body and a second layer disposed over the first layer, the second layer being formed by the optically refractive layer.

7. A speaker dome according to claim 6, wherein the first layer has a thickness in the range 10 nm to 5 μm, 50 nm to 1 μm, or 50 nm to 500 nm.

8. A speaker dome according to claim 6, wherein the first layer is opaque.

9. A speaker dome according to claim 8, wherein the first layer is reflective.

10. A speaker dome according to claim 6, wherein the first layer is formed of a metal or metal alloy.

11. A speaker dome according to claim 6, wherein the first layer is formed of one or more of titanium, tungsten, silicon, silver, platinum, aluminium, or gold, or an alloy thereof.

12. A speaker dome according to claim 6, wherein the coating consists of only the first and second layers.

13. A speaker dome according to claim 6, wherein the first and second layers form continuous layers over at least 90% of at least one side of the dome body.

14. A speaker dome according to claim 1, wherein the dome body is formed of a material with a Young's modulus greater than 100 GPa, 200 GPa, 300 GPa, 500 GPa, or 1000 GPa.

15. A speaker dome according to claim 1, wherein the dome body has a thickness in the range 5 μm to 500 μm, 20 μm to 100 μm, 30 μm to 70 μm, or 40 μm to 50 μm.

16. A speaker dome according to claim 1, wherein a break-up frequency thereof is greater than 25 kHz and a deviation in an on-axis response curve from a flat response, measured at ⅘ of the break-up frequency, of less than 3 dB.

17. A speaker dome according to claim 1, wherein the coating is disposed on a convex side of the dome body.

18. A speaker dome according to claim 1, wherein the coating is disposed on a concave side of the dome body.

19. A method of forming a speaker dome according to claim 1, comprising:

providing a polycrystalline diamond dome body; and coating at least one side of a polycrystalline diamond dome body with a coating, wherein the coating comprises an optically refractive metal compound layer which is semi-transparent and which forms one or more colours via interference of reflected light from front and rear surfaces of the layer.

20. A method according to claim 19, wherein the coating comprises at least two layers including a first layer bonded to the at least one side of the dome body and a second layer disposed over the first layer, the second layer being formed by the optically refractive metal compound layer.

21. A method according to claim 20, wherein the first layer is deposited on the at least one side of the dome body via vacuum deposition, sputtering, electroless plating, evaporative coating, powder coating, wet spray coating, or dip coating.

22. A method according to claim 19, wherein the optically refractive metal compound layer is deposited via vacuum deposition, sputtering, electroless plating, evaporative coating, powder coating, wet spray coating, or dip coating.

23. A diamond component comprising:

a diamond body; and a coating on at least one side of the diamond body, wherein the coating comprises at least two layers including a first layer bonded to the at least one side of the diamond body and a second layer disposed over the first layer, the second layer being an optically refractive metal compound coating which is semi-transparent and which forms one or more colours via interference of reflected light from front and rear surfaces of the second layer.

* * * * *